US008950555B2

(12) United States Patent
Brand

(10) Patent No.: US 8,950,555 B2
(45) Date of Patent: Feb. 10, 2015

(54) METHOD FOR SCHEDULING CARS IN ELEVATOR SYSTEMS TO MINIMIZE ROUND-TRIP TIMES

(75) Inventor: Matthew Brand, Newtonville, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 767 days.

(21) Appl. No.: 13/091,394

(22) Filed: Apr. 21, 2011

(65) Prior Publication Data

US 2012/0267201 A1 Oct. 25, 2012

(51) Int. Cl.
*B66B 1/18* (2006.01)
*B66B 1/24* (2006.01)

(52) U.S. Cl.
CPC ..... *B66B 1/2458* (2013.01); *B66B 2201/213* (2013.01); *B66B 2201/215* (2013.01); *B66B 2201/222* (2013.01)
USPC ..... 187/382; 187/392

(58) Field of Classification Search
USPC ..... 187/247, 380–389, 391–393
See application file for complete search history.

(56) References Cited

U.S. PATENT DOCUMENTS

| | | | | |
|---|---|---|---|---|
| 4,492,288 | A | 1/1985 | Schroeder | |
| 4,691,808 | A | 9/1987 | Nowak et al. | |
| 4,792,019 | A * | 12/1988 | Bittar et al. | 187/385 |
| 4,846,311 | A * | 7/1989 | Thangavelu | 187/383 |
| 4,926,976 | A * | 5/1990 | Schroder | 187/247 |
| 7,117,980 | B2 * | 10/2006 | Wyss et al. | 187/383 |
| 7,650,966 | B2 * | 1/2010 | Sansevero et al. | 187/249 |
| 8,220,591 | B2 * | 7/2012 | Atalla et al. | 187/383 |
| 8,397,874 | B2 * | 3/2013 | de Groot | 187/382 |
| 2012/0125719 | A1 * | 5/2012 | Sundholm et al. | 187/382 |
| 2012/0255813 | A1 * | 10/2012 | Atalla et al. | 187/382 |
| 2013/0206517 | A1 * | 8/2013 | De Jong et al. | 187/381 |

FOREIGN PATENT DOCUMENTS

WO 2009116986 A1 9/2009

OTHER PUBLICATIONS

Daniele Gardy et al. "Urn Models and Yao's Formula," Lecture Notes in Computer Science vol. 1540, pp. 100-112, Springer-Verlag, 1999.

* cited by examiner

*Primary Examiner* — Anthony Salata
(74) *Attorney, Agent, or Firm* — Dirk Brinkman; Gene Vinokur

(57) ABSTRACT

A set of cars in an elevator system are scheduled by assigning passengers to the cars such that a current schedule for each car does not exceed a predetermined maximum number of stops per round trip, and the car is filled as near as possible to a maximum capacity at a predetermined bottleneck.

18 Claims, 2 Drawing Sheets

METHOD FOR SCHEDULING CARS IN ELEVATOR SYSTEMS TO MINIMIZE ROUND-TRIP TIMES

FIELD OF THE INVENTION

This invention relates generally to elevator systems, and more particularly to scheduling cars in the elevator systems to minimize round-trip times while assigning passengers to the cars according to a schedule.

BACKGROUND OF THE INVENTION

It is well known that a performance of an elevator system can be improved by maximizing the number of passengers in each car, and by minimizing round-trip times of the cars.

However, these two goals are at odds with each other. More passengers per car means more stops. This increases the round-trip times.

That is a combinatorial problem, which cannot be solved optimally in a practical time for real-world systems. A further complication is during heavy traffic, cars may not be able to service all assigned passengers in a single round-trip.

SUMMARY OF THE INVENTION

A set of cars in an elevator system are scheduled by assigning passengers to the cars such that a current schedule for each car does not exceed a predetermined maximum number of stops per round trip, and the car is filled as near as possible to a maximum capacity at a predetermined bottleneck.

Passengers with common stops are assigned to the same car to minimize round-trip times, and the round-trip times are approximated by an affine function of the number of stops and the number of the passengers.

DETAILED DESCRIPTION OF THE PREFERRED EMBODIMENTS

The embodiments of the invention provide a method for scheduling ears in an elevator system. The method is particularly applicable during periods of heavy traffic when bottlenecks can occur during a round trip when the cars are full. A bottleneck is defined, as a part of a motion cycle of the cars where the number of passengers is most likely to meet or exceed a rated capacity of the cars. Therefore, the method assigns passengers with common stops 201 to the same car to minimize round-trip times, while maximizing utilization at the bottleneck.

Figure 1A:
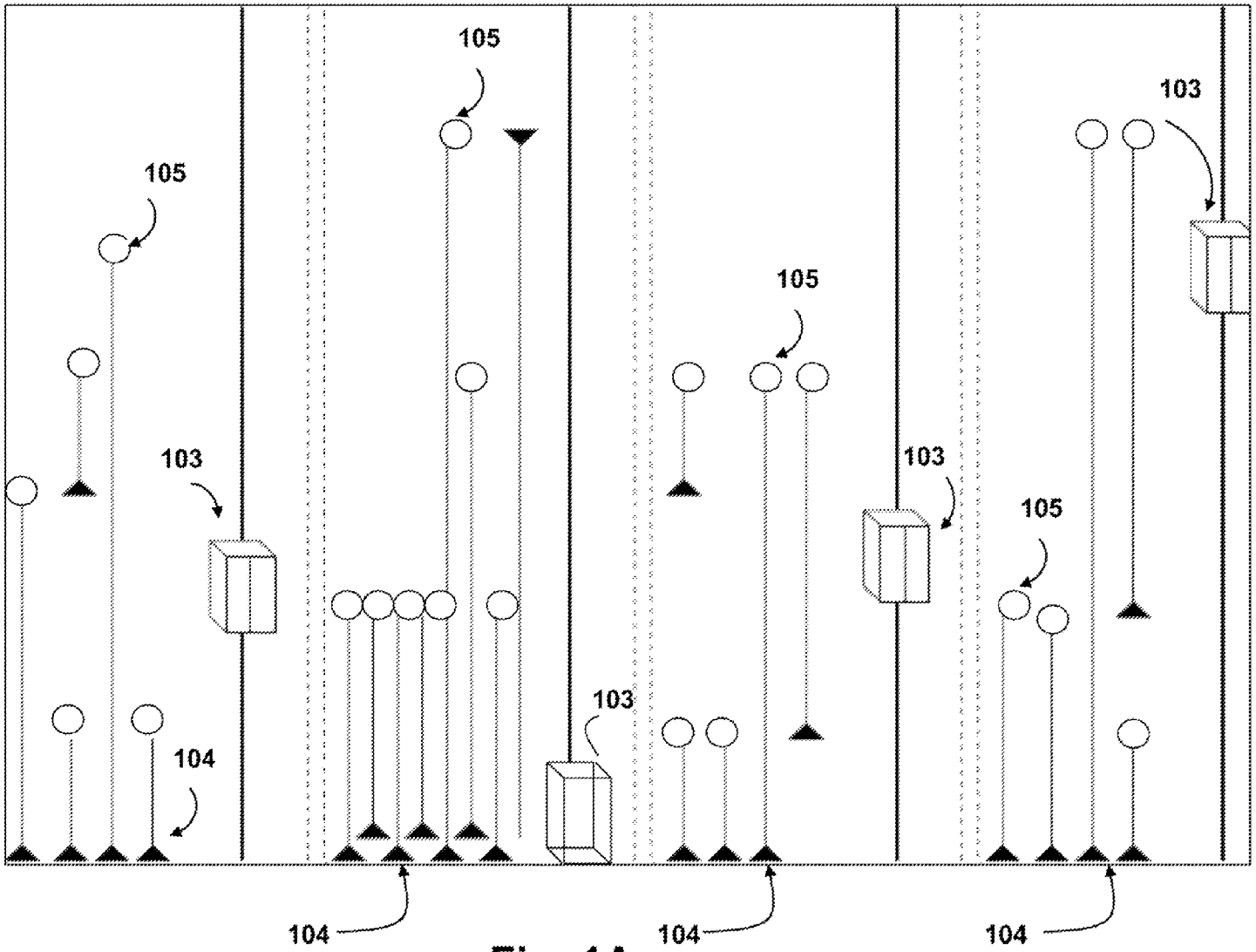
FIG. 1A is a schematic of a group elevator system with assigned pickups and dropoffs for each car according to embodiments of the invention.

As shown in FIG. 1A, in the early morning when up traffic is at a peak, the bottleneck is usually between the ground floor and the first possible upward stop. In the late afternoon when down traffic is at a peak, the bottleneck is usually between the last possible downward stop and the ground floor.

Figure 1B:
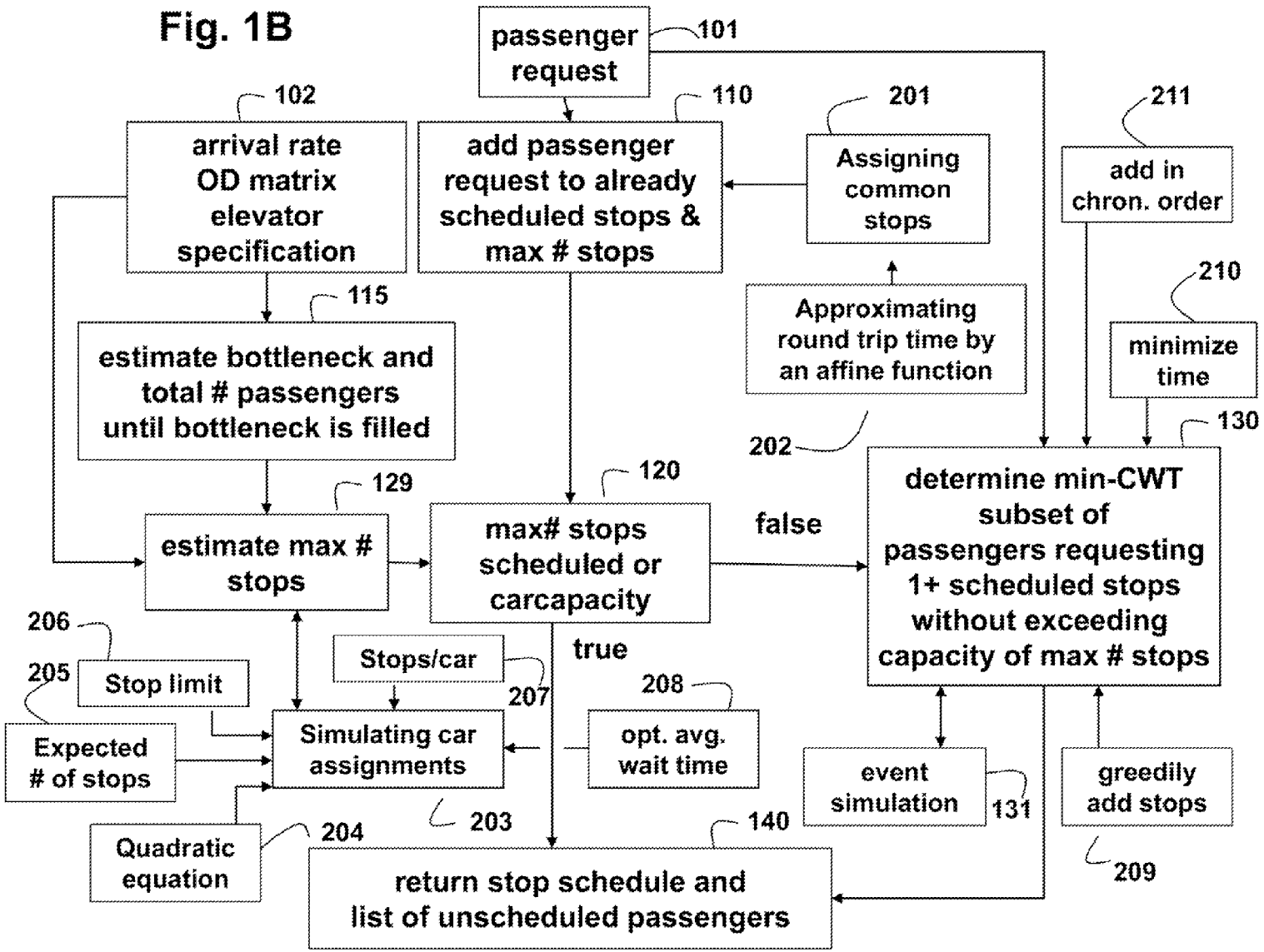
FIG. 1B is a block diagram of a method for flow diagram of a method for scheduling cars in an elevator system to minimize round-trip according embodiments of the invention.

FIG. 1A shows a group elevator system with four shafts. Each car 103 is associated with a current position a set of pick-ups 104 (triangles), and a set of drop-offs 105 (circles) assigned to the car. Components of the elevator system, e.g., cars, car and floor doors and call buttons, are connected to a processor including memory and input/output interfaces as known in the art. The processor performs the method as shown in FIG. 1B.

During the periods of heavy traffic, it is always rational to fill each car to capacity at the bottleneck. Consequently, the expected number of passengers per round trip is essentially a constant determined by the bottleneck capacity, and the round-trip time is essentially determined by the number of stops.

The expected round-trip time is remarkably well approximated by an affine function 202 of the number of stops and of the number of passengers. Each stop and each passenger adds an almost constant time cost. The car motion time per round trip is also almost constant because of the nonlinear acceleration and deceleration times tend to be quite small relative to all the other linear determinants of elevator scheduling.

In an unsaturated system, the cumulative wait time (CWT) for passengers assigned to each car is a quadratic function of the round-trip time, because the number of new passenger arrivals and the waits of all passengers grow linearly with the round-trip time. With fewer stops, passengers are deferred to later round-trips. With more stops, passengers arrive faster than they can be serviced, causing the system to saturate.

For an elevator system, the optimal number of stops per round trip can be estimated using any of the following methods. One can extensively test and simulate 203 various hard limits on the number of stops allowed per round trip, where the hard limit gives an optimal average waiting times 208. From physical system parameters, one can also derive. An expected arrival rate, the quadratic function 204 that predicts cumulative weight time as a function of the expected number of stops 205, and selects a stop limit 206 that minimizes this quadratic function. Alternatively, one can estimate of the number of stops needed to service all passengers when the arrival rate of the passengers matches the bottleneck capacity.

The last method is expanded upon here as shown in FIG. 1. The specification 102 of the passenger arrival rate and an origin-destination (OD) matrix of passenger traffic are known. From the OD matrix, the bottleneck and the total number of arrivals a, before the number of passengers passing through the bottleneck exceeds capacity of the car, can be estimate 115. The maximum number of stops the car makes to service all arrivals is also estimated 129.

This is equivalent to the well known ball-and-urn occupancy problem, where the number of nonempty urns is determined after n balls are randomly placed into f urns. A slightly more complicated urn occupancy problem is considered here.

Given f possible destination floors, a d-deck elevator with f/d stop locations, per-floor capacity c, and n passenger requests drawn from a uniform distribution, the expected number E[X] of stops is $$E[X] = \frac{f}{d}\left(1 - \frac{\binom{(f-d)c}{n}}{\binom{fc}{n}}\right) \approx \frac{f}{d}\left(1 - \left(1 - \frac{n}{cf}\right)^{dc}\right).$$

For up-peak and down-peak traffic, each passenger makes a stop request other than the lobby, so n=a. For uniform interfloor traffic, each passenger requests a boarding stop and a disboarding stop, so n=2a.

The expected number of stops 205 is divided by the number of cars to determine the expected number of stops per car 207, assuming that passengers arrive at random and are optimally assigned to cars. In reality, the passengers cannot be optimally assigned.

Therefore, a slightly larger number of stops are obtained by adding a fraction k of a standard deviation $\sqrt{\sigma^2[X]}$ to E[X], with $$\sigma^2[X] = \frac{f}{d}\left(\frac{f}{d}-1\right)\frac{\binom{(f-2d)c}{n}}{\binom{fc}{n}} - \left(\frac{f}{d}\frac{\binom{(f-d)c}{n}}{\binom{fc}{n}}\right)^2 + \frac{f}{d}\frac{\binom{(f-d)c}{n}}{\binom{fc}{n}} \approx \frac{f}{d}\left(1-\frac{n}{fc}\right)^d\left(1-\frac{dn}{fc-n}\left(1-\frac{n}{fc}\right)^d\right).$$

In an elevator system with a large number of cars, the number of stops X can be approximated by a Gaussian distribution. Therefore, the expected number of stops, $\lceil[X]+k\sqrt{\sigma^2[X]}\rceil$, is more than adequate to service n passengers $\Psi(k)$ of the time, where $\Psi$ is the Gaussian cumulative distribution function (CDF), also known as the error function. For example $\Psi(1)\approx 84\%$, and $\Psi(2)\approx 99.5\%$.

As a policy, the elevator scheduling method according to the embodiments of the invention uses the above analysis to set a maximum number of stops per round-trip. As described above, this policy enables the elevator system to achieve the bottleneck capacity, while minimizing the round-trip time. Thus, the CWT is relatively low.

This policy also has a number of computational advantages. For example, one can immediately rule out any assignment that causes a car to exceed the maximum number of stops per round-trip, without doing any of the simulation that usually accompanies assignment decisions.

In this section and as shown in FIG. 1, the method for scheduling stops of cars for passengers, assigning the passengers to cars, and estimating 130 the CWT is described in greater detail.

Then, the CWT estimates can be use to make car assignments. The following variables are known for each car:

position and velocity;

number of passengers;

arrival and destination floors for the passengers; and current schedule of stops.

The method is responsive the passenger request 101 for a car. The passenger request is added 110 to already scheduled stops and the maximum number of stops.

The method checks 120 if the added request is less than the maximum number of stops, or the car capacity per round-trip. If true, return 140 the stop schedule and a list of unscheduled passengers.

If false, then the minimum CWT for the subset of passengers requesting scheduled stops without exceeding the car capacity and the maximum number of stops, and return 140 the schedule and the list of unscheduled passengers to accommodated in later round-trips, which are returned 140. Step 130 is performed by a deterministic discrete event simulation 131 and search strategies.

The method commits to serve any passengers that can be fully accommodated within the current stop schedule and car capacity limits. This is done in a greedy manner 209, i.e., in order of boarding, because in practical applications one cannot prevent a passenger from hoarding an elevator that is already scheduled to stop at the arrival and destination floors of the passenger.

If the current schedule can accommodate p more stops before exceeding the maximum number of stops per round-trip, a list of all yet-unscheduled arrival and destination floors of the remaining uncommitted passengers is constructed and returned 140.

Then, various p-sized subsets of these requested floors are added to the scheduled stops, along with the passengers that are thus accommodated. Each subset is scored according to the CWT for all accommodated passengers plus a heuristic penalty for each passenger who cannot be accommodated until the next round-trip. Typically, this penalty is the time of a round-trip. Depending on the available, computational resources, various deterministic search strategies can be used. For example, in a descending order of efficacy:

depth-first search through the list of requested stops for the best-scoring combination;

greedily adding the stops 209 that maximize the number of additional accommodated passengers;

adding stops that minimally extend the travel time 210 of the round trip; and adding stops 211 in the chronological order that the stops were requested.

The main advantage of this scheme is that only the space of stops is searched, which is considerably smaller than the space of passenger orderings.

The CWT is precise when all passengers can be accommodated in one round trip. Otherwise, the CWT is heuristic, but justifiably so because new passengers entering the system make accurate long-term predictions impossible.

This method supports two useful variations. In an immediate mode, the method schedules all stops included in the CWT determination immediately. In a reassignment mode, the method only schedules for some predetermined time in the future, and passengers with unscheduled stops in the current CWT determination can be opportunistically reassigned to other cars that can accommodate the passengers with less delay.

As an example, the maximum-stops heuristic can be used with greedy chronological scheduling to schedule several thousand hours of passenger traffic in an elevators systems with varying number of cars and traffic flows. The heuristic reduced average waiting times by 20-50% compared to a nearly identical scheduler in which any number of stops can be scheduled.

Although the invention has been described with reference to certain preferred embodiments, it is to be understood that various other adaptations and modifications can be made within the spirit and scope of the invention. Therefore, it is the object of the append claims to cover all such variations and modifications as come within the true spirit and scope of the invention.

I claim:

1. A method for scheduling a set of cars in an elevator system, the method comprising for each car the steps of:

assigning passengers to the car such that a current schedule (CS) for the car does not exceed a predetermined maximum number of stops per round trip (MS); and filling the car as near as possible to a maximum capacity (MC) at a predetermined bottleneck.

2. The method of claim 1, further comprising:

assigning the passengers with common stops to the same car to minimize round-trip times.

3. The method of claim 2, further comprising:

approximating the round-trip times by an affine function of the number of stops and the number of the passengers.

4. The method of claim 1, further comprising:

estimating an optimal number of stops by simulating car assignments with a hard limit on the number of stops.

5. The method of claim 1, further comprising:

estimating an optimal number of stops by deriving of a quadratic function from physical system parameters and an expected arrival rate.

6. The method of claim 1, further comprising:

estimating an optimal number of stops by estimating the number of stops needed to service all passengers when an expected arrival rate of the passengers matches a bottleneck capacity.

7. The method of claim 1, wherein an expected number E[X] of stops for all cars is $$E[X] = \frac{f}{d}\left(1 - \frac{\binom{(f-d)c}{n}}{\binom{fc}{n}}\right) \approx \frac{f}{d}\left(1 - \left(1 - \frac{n}{cf}\right)^{dc}\right),$$

where f are possible destination floors, d is a number of cars with f/d stop locations, c is a per-floor capacity, and n represents passenger requests drawn from a uniform distribution.

8. The method of claim 7, further comprising:

dividing the expected number of stops by the number of cars to determine the expected number of stops per car.

9. The method of claim 1, wherein a total number of requested stops is less than or equal to the MS, and a cumulative waiting time for all the passengers making all the stops is determined by a deterministic discrete event simulation.

10. The method of claim 1, further comprising:

scheduling any passengers to be picked up and can be accommodated within the CS as long as the MS for the car is not exceeded.

11. The method of claim 10, wherein the scheduling is in an order of boarding by the passengers.

12. The method of claim 1, wherein a schedule with an optimal number of stops is estimated by simulating car assignments with a hard limit on the number of stops, and selecting the hard limit giving an optimal average cumulative waiting time.

13. The method of claim 1, wherein a schedule with an optimal number of stops is estimated by deriving of a quadratic function from physical system parameters and an expected arrival rate of the passengers.

14. The method of claim 1, wherein a schedule with an optimal number of stops is estimated by estimating the number of stops needed to service all passengers when an expected arrival rate of the passengers matches a bottleneck capacity.

15. The method of claim 1, further comprising:

constructing a list of all unscheduled arrival floors and destination floors of remaining uncommitted passengers.

16. The method of claim 13, further comprising:

adding greedily stops that maximize a number of passengers on board the car.

17. The method of claim 13, further comprising:

adding stops that minimally extend a round trip time of the car.

18. The method of claim 15, further comprising:

adding stops in a chronological order of when the stops are requested.

* * * * *